US008284967B2

(12) United States Patent
Yang et al.

(10) Patent No.: US 8,284,967 B2
(45) Date of Patent: Oct. 9, 2012

(54) ELECTROSTATIC SPEAKER HAVING VENTILATIVE DIAPHRAGM

(76) Inventors: Kilseob Yang, Gimpo-si (KR); Hye-won Yang, Gimpo-si (KR); Sung-min Yang, Gimpo-si (KR)

( * ) Notice: Subject to any disclaimer, the term of this patent is extended or adjusted under 35 U.S.C. 154(b) by 580 days.

(21) Appl. No.: 12/305,622

(22) PCT Filed: Jun. 26, 2007

(86) PCT No.: PCT/KR2007/003076

§ 371 (c)(1),
(2), (4) Date: Dec. 18, 2008

(87) PCT Pub. No.: WO2008/002049

PCT Pub. Date: Jan. 3, 2008

(65) Prior Publication Data

US 2010/0278363 A1 Nov. 4, 2010

(30) Foreign Application Priority Data

Jun. 28, 2006 (KR) ..... 10-2006-0058359
Feb. 8, 2007 (KR) ..... 10-2007-0013000

(51) Int. Cl.
*H04R 19/02* (2006.01)

(52) U.S. Cl. ..... 381/191; 381/423; 381/428

(58) Field of Classification Search ..... 381/191, 381/423–433

See application file for complete search history.

(56) References Cited

U.S. PATENT DOCUMENTS

| | | | | |
|---|---|---|---|---|
| 3,892,927 | A | 7/1975 | Lindenberg | |
| 6,584,206 | B2 | 6/2003 | Ohashi | |
| 7,822,216 | B2 * | 10/2010 | Ohashi et al. | 381/190 |
| 7,881,489 | B2 * | 2/2011 | Matsuzawa et al. | 381/396 |
| 7,888,840 | B2 * | 2/2011 | Shimaoka et al. | 310/309 |
| 2007/0195976 | A1 * | 8/2007 | Sekino et al. | 381/191 |
| 2007/0242844 | A1 * | 10/2007 | Harman | 381/191 |

FOREIGN PATENT DOCUMENTS

| | | | |
|---|---|---|---|
| JP | 3892927 | | 7/1975 |
| JP | 08-298697 | | 11/1996 |
| JP | 8298697 | | 11/1996 |
| JP | 11-113092 | | 4/1999 |
| JP | 35-006301 | | 3/2004 |
| JP | 2002-135896 | | 4/2004 |
| JP | 2006-074102 | | 3/2006 |
| JP | 46-026371 | | 2/2011 |
| KR | 2005039177 | * | 4/2005 |

* cited by examiner

*Primary Examiner* — Savitr Mulpuri

(74) *Attorney, Agent, or Firm* — John K. Park; Park Law Firm

(57) ABSTRACT

The present invention relates to an electrostatic speaker including a fixed electrode and a diaphragm that is arranged with a predetermined gap from the fixed electrode and has a plurality of ventilation holes. The ventilative diaphragm reduces air resistance caused by the ground effect between the fixed electrode and the diaphragm, and increases the sound pressure output from the speaker. As a result, the ventilative diaphragm makes it possible to obtain a uniform frequency reproduction characteristic over the entire frequency range. In particular, when the diaphragm is made from Korean paper, it is possible to effectively reduce the ground effect occurring between the fixed electrode and the diaphragm due to the air permeable characteristic of the Korean paper and the air resistance due to a surge input signal, while satisfying physical characteristics of the existing diaphragm. In addition, since the Korean paper has high formability, it is possible to easily form the diaphragm in a hemispherical shape. As a result, it is possible to radially and uniformly spread the sound by a simple structure.

7 Claims, 8 Drawing Sheets

[Fig. 1]
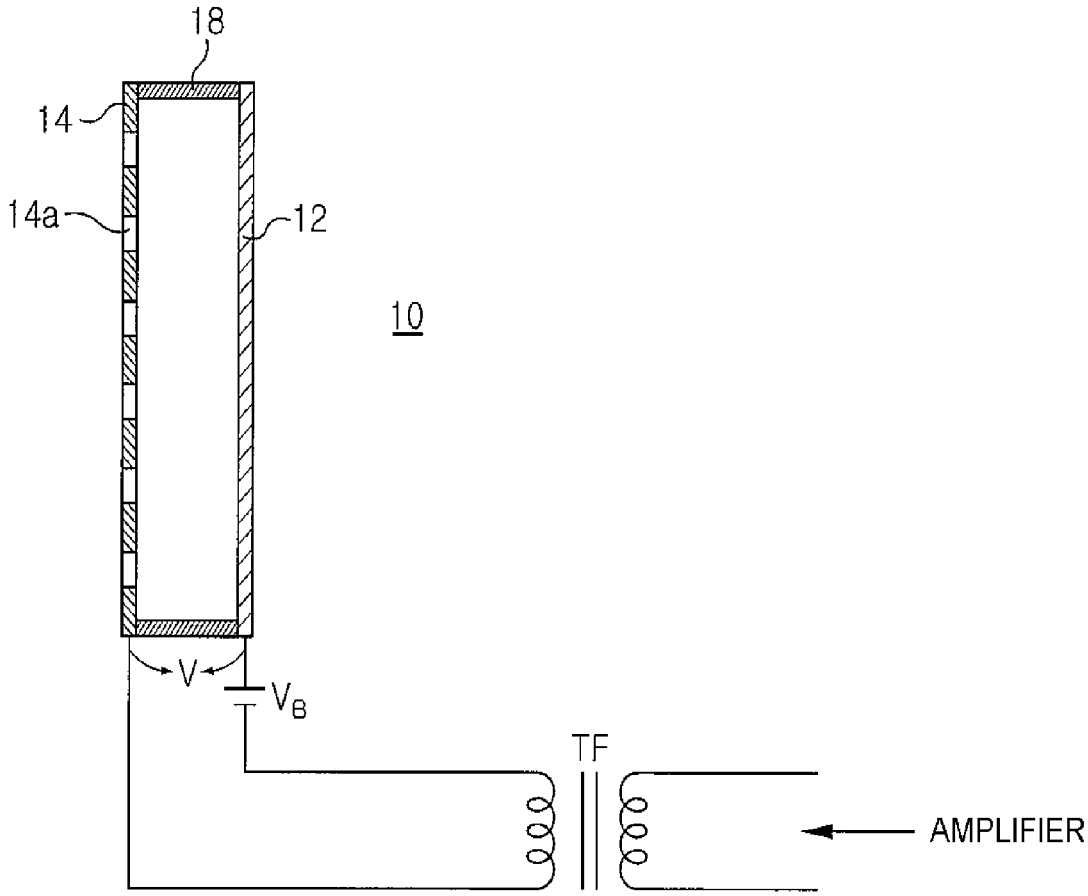

[Fig. 2]
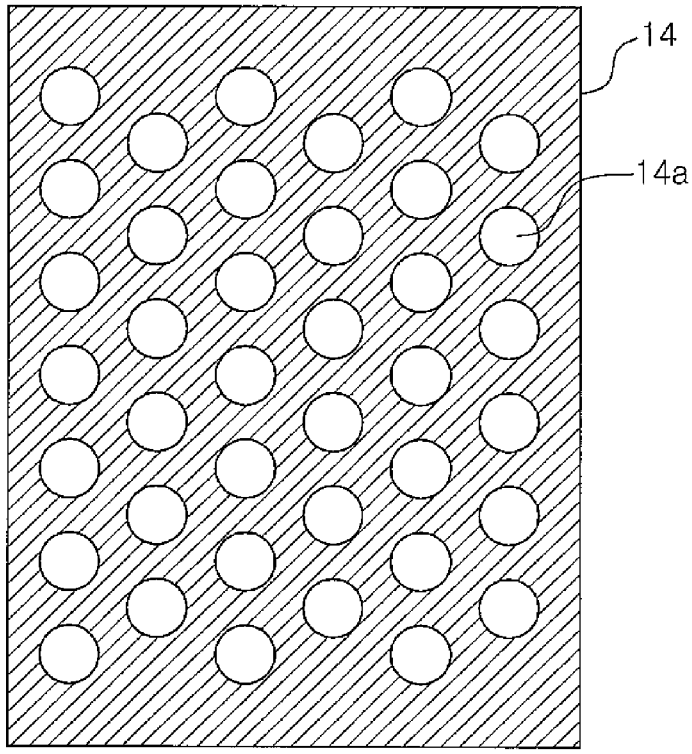
[Fig. 3]
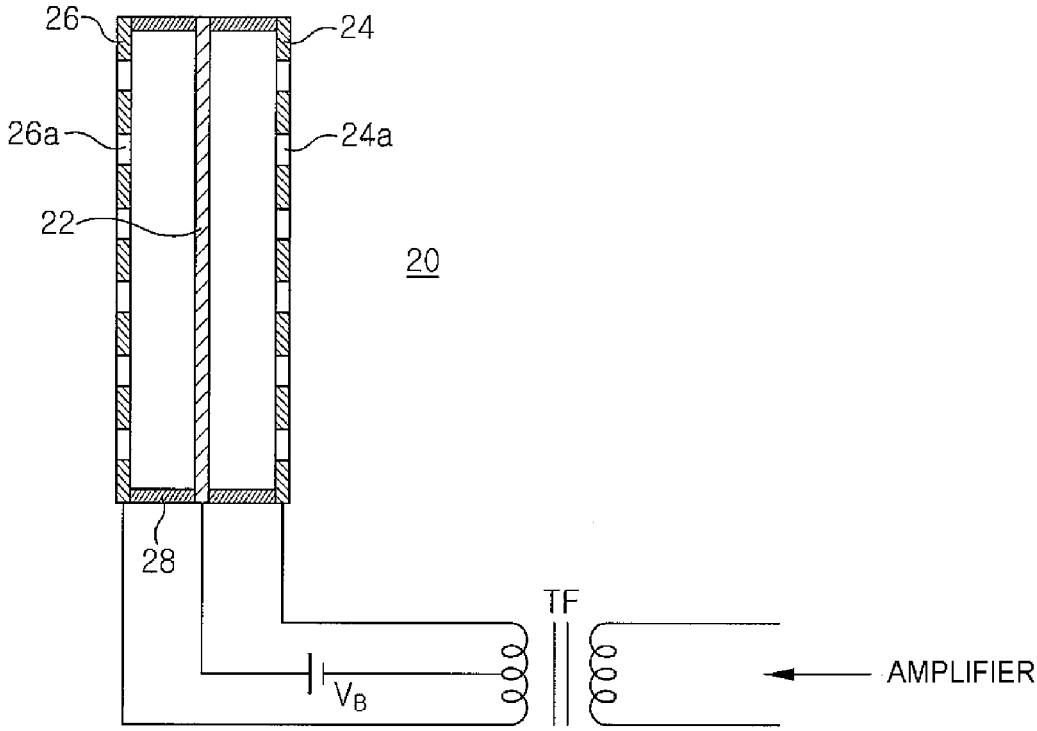

[Fig. 4]
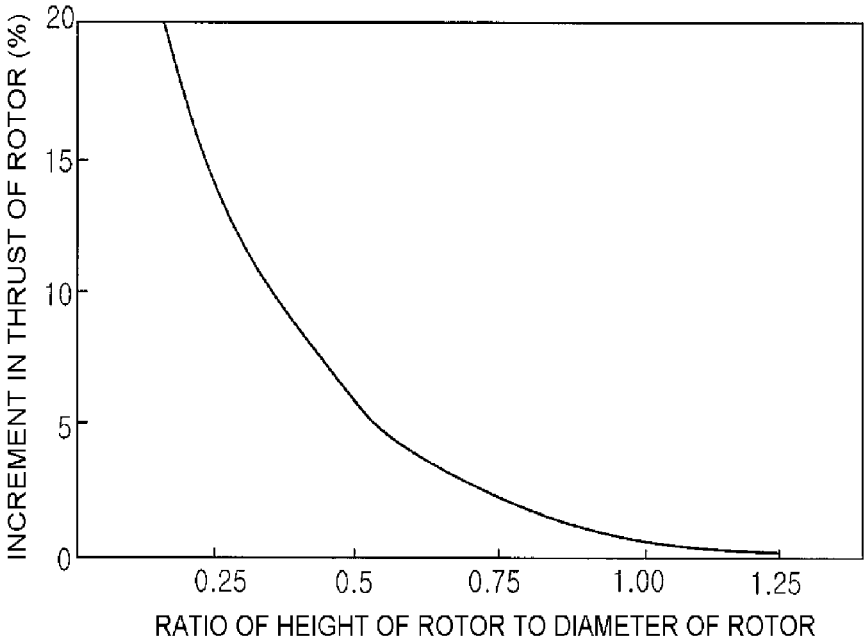
[Fig. 5]
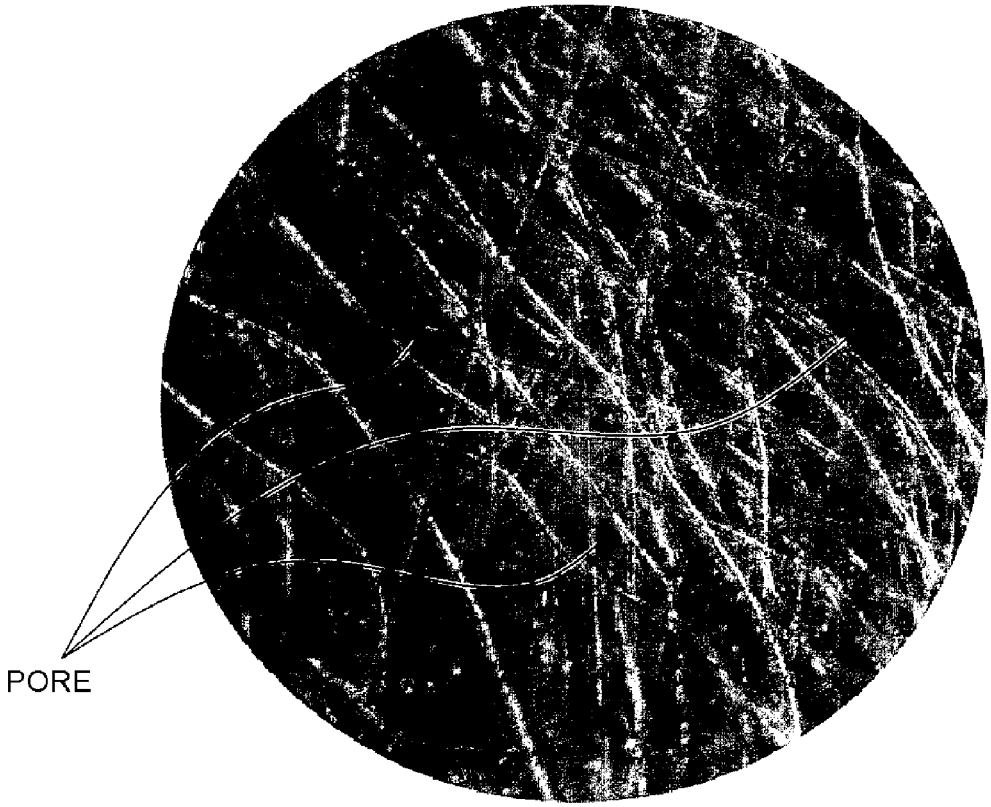

[Fig. 6]
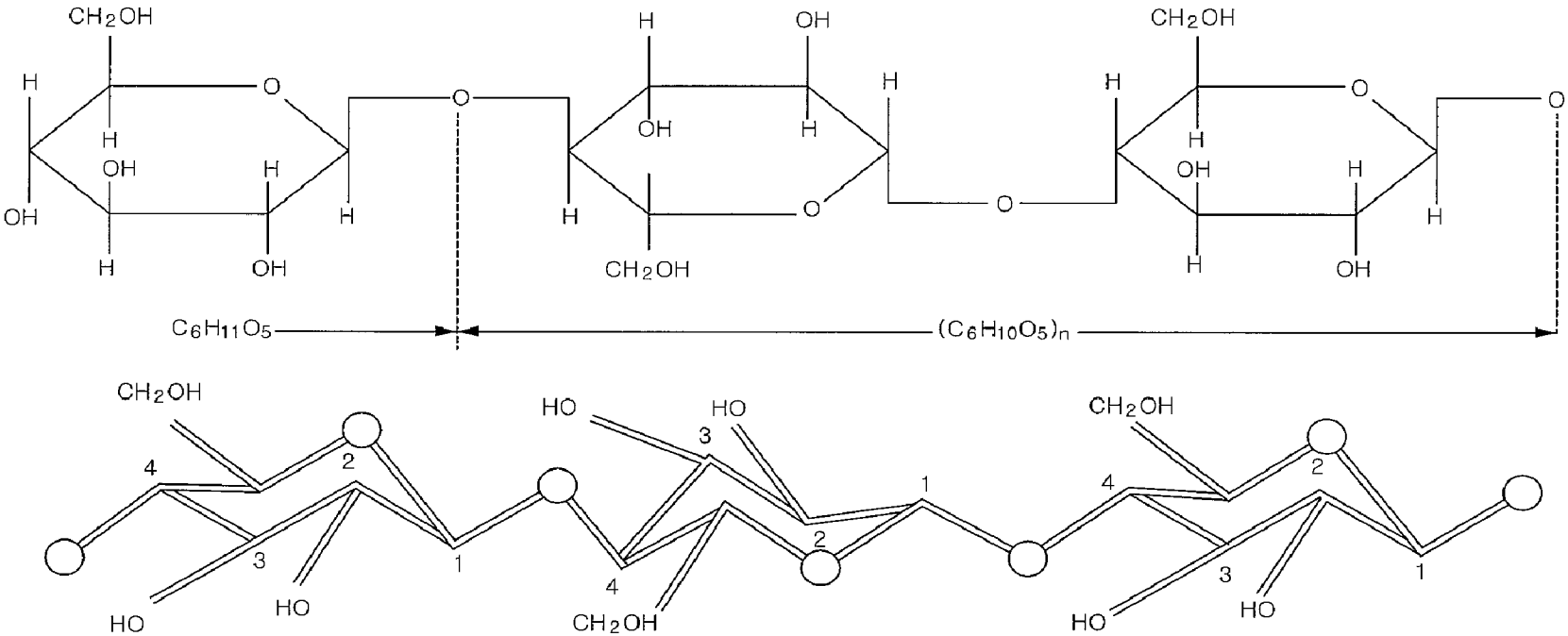

[Fig. 7]
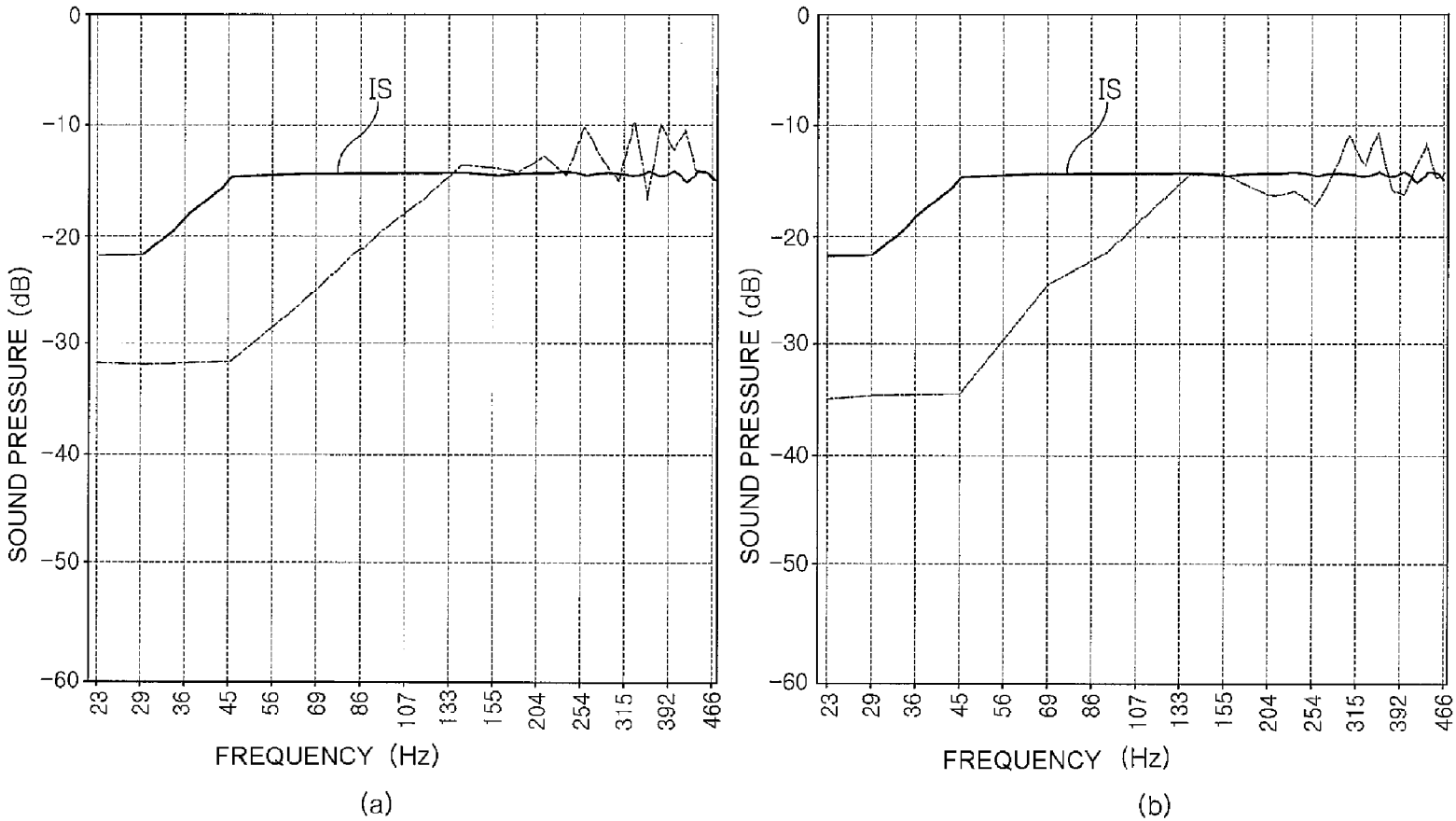

[Fig. 8]
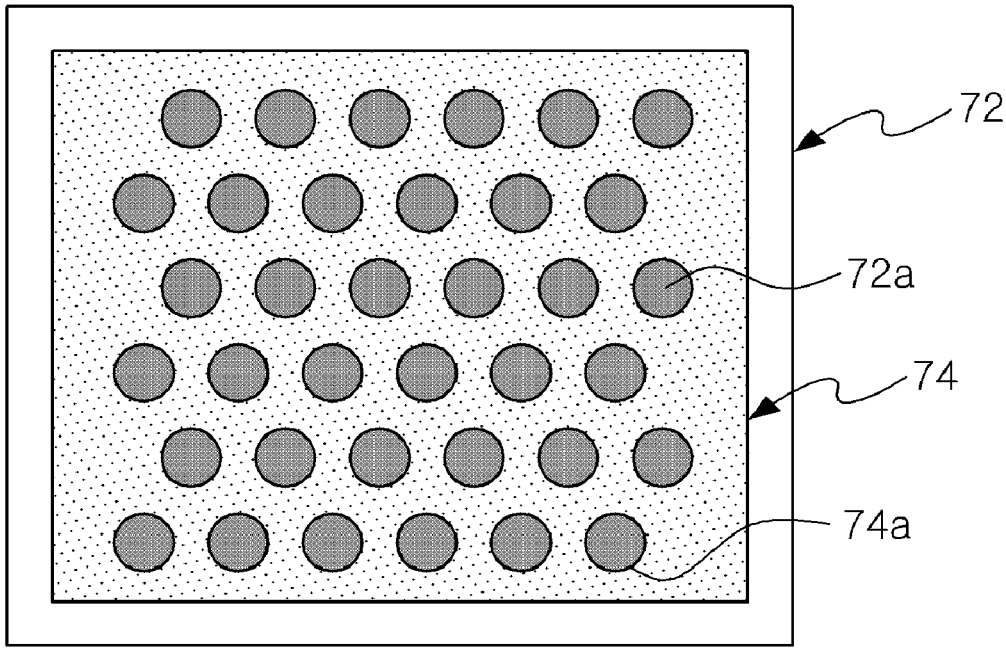

[Fig. 9]
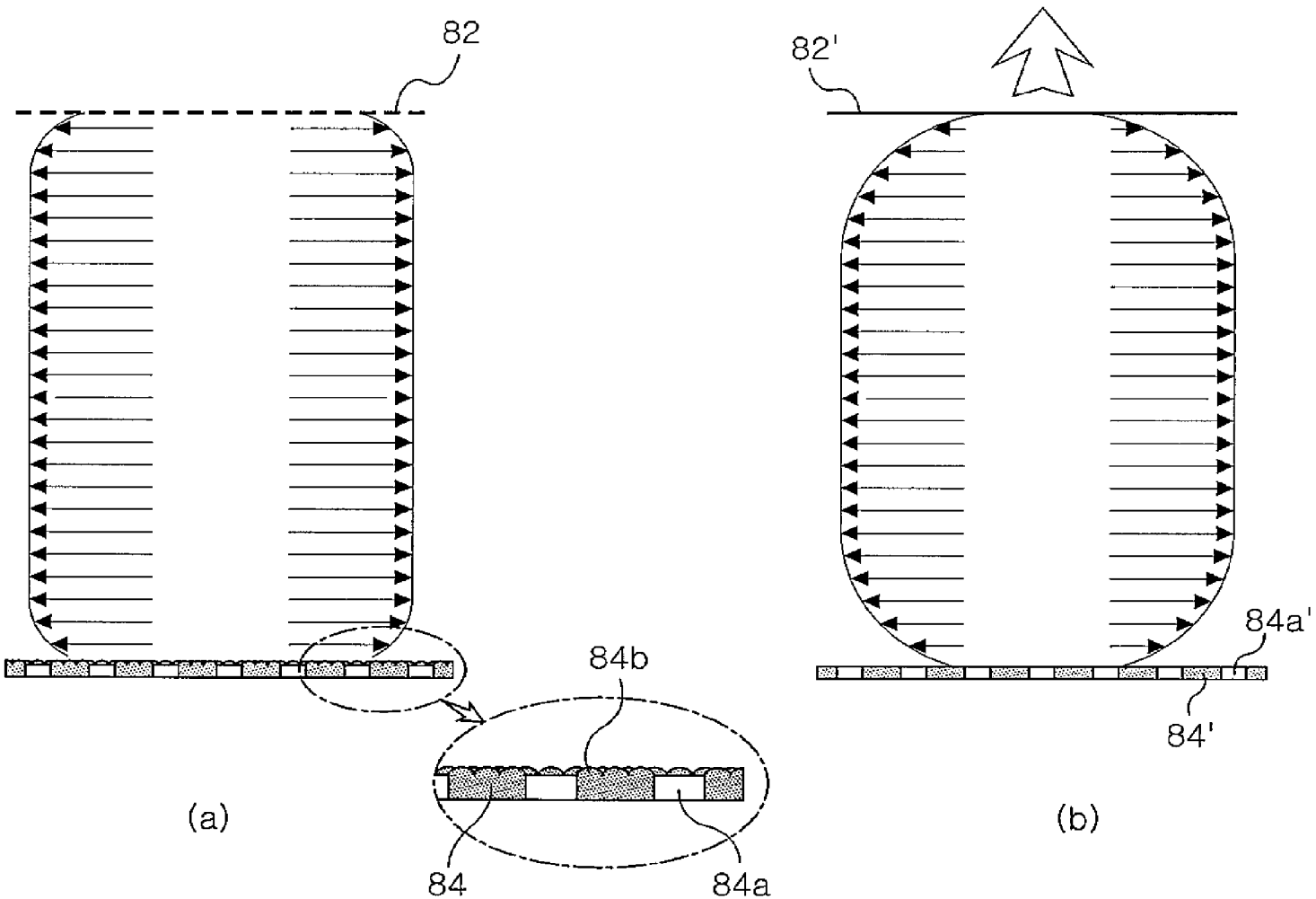

[Fig. 10]
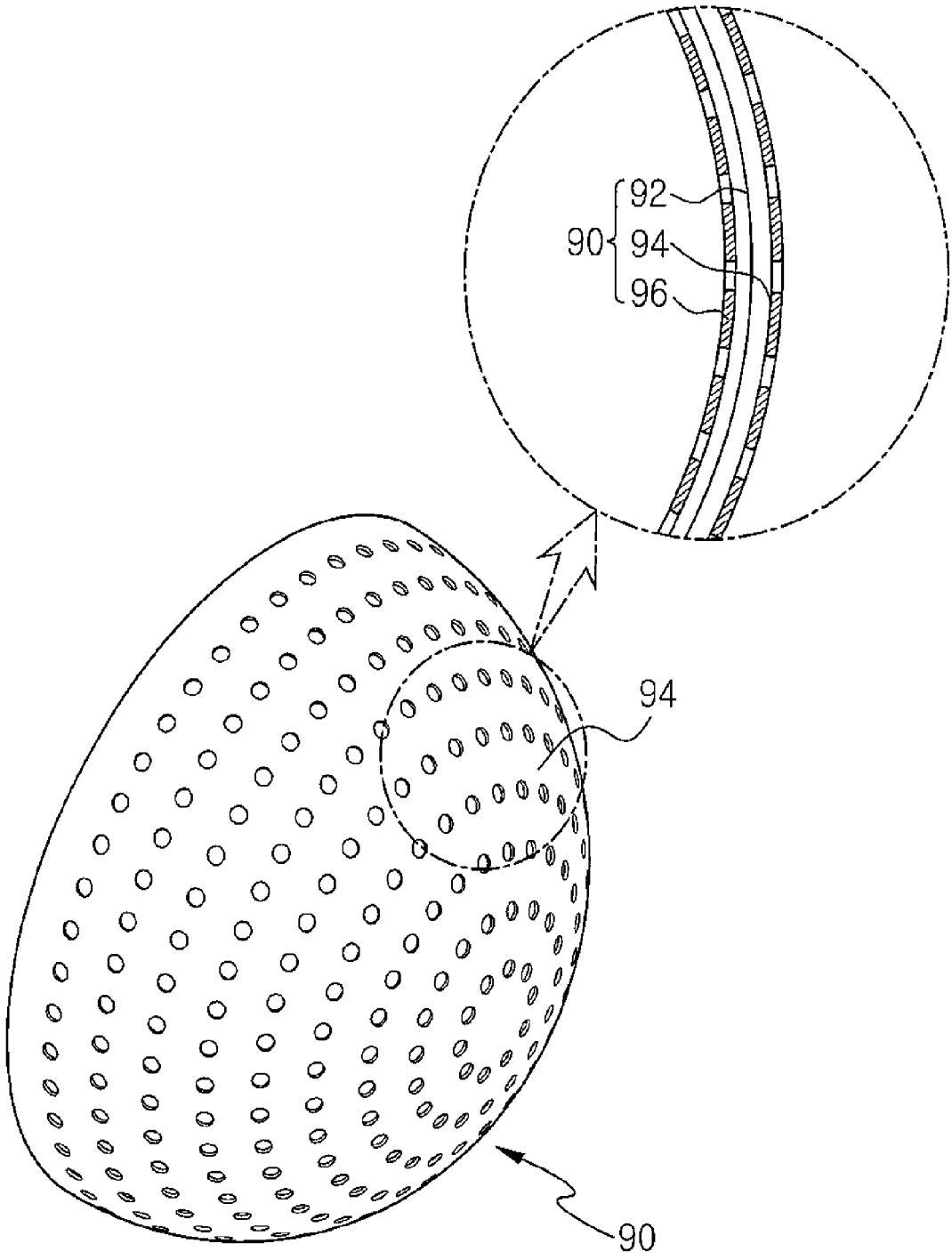

ELECTROSTATIC SPEAKER HAVING VENTILATIVE DIAPHRAGM

TECHNICAL FIELD

The present invention relates to an electrostatic speaker, and more particularly, to an electrostatic speaker having a ventilative diaphragm capable of improving a low frequency characteristic and reproducing a natural sound.

BACKGROUND ART

Electrostatic speakers generate sound pressure when a driving signal is input to a fixed electrode and a DC bias voltage is applied to a diaphragm. The diaphragm is charged with a higher voltage than the fixed electrode, and when an audio signal is transmitted to the fixed electrode, an electrostatic field is generated in response to the audio signal. The variable electrostatic field generated around the fixed electrode interacts with a fixed electrostatic field of the diaphragm which causes the diaphragm to be both pulled and pushed, resulting in the generation of sound.

The electrostatic speakers include a single ended speaker having a diaphragm and a single fixed electrode that are arranged in parallel to each other, and a double ended speaker having a diaphragm and a pair of fixed electrodes arranged at both sides of the diaphragm.

FIGS. 1 and 2 show the schematic structure of a general single ended speaker. The speaker includes a sound generator 10 having a diaphragm 12 and a fixed electrode 14, and a plurality of holes 14*a* are formed in the fixed electrode 14.

In addition, insulating supports 18 are formed between both ends of the diaphragm 12 and the fixed electrode 14. The level of an audio signal input from an amplifier (not shown) is increased by an audio frequency transformer TF.

One output node of the transformer TF is connected to the fixed electrode 14, and the other output node thereof is connected to a negative pole node of a bias voltage source $V_B$. An positive pole node of the bias voltage source $V_B$ is connected to the diaphragm 12. The bias voltage source $V_B$ makes the speaker charged and maintained at a consistent charging capacity.

The diaphragm 12 has a consistent voltage and a consistent charging capacity in an equilibrium state, and a voltage V is applied between the diaphragm 12 and the fixed electrode 14. The voltage between the fixed electrode 14 and the diaphragm 12 varies according to an amplified audio signal, and then the balance between attractive force and repulsive force applied to the diaphragm 12 is upset, which causes the diaphragm 12 to move, resulting in the generation of sound.

FIG. 3 shows the schematic structure of a general double ended speaker. The double ended speaker is formed by adding one fixed electrode to the sound generator of the single ended speaker, in order to improve the driving force of the diaphragm. That is, the double ended speaker includes a sound generator 20 having two fixed electrodes 24 and 26. In this way, the double ended speaker reduces the distortion of sound and increases the level of sound pressure.

In the double ended speaker, the bias voltage $V_B$ is applied between a diaphragm 22 and an intermediate node of a secondary coil of the transformer TF. When amplified audio signals are input to two fixed electrodes 24 and 26, the diaphragm 22 receives the attractive force from one of the two fixed electrodes 24 and 26 and the repulsive force from the other fixed electrode to vibrate, thereby generating sound.

A plurality of holes 24*a* and 26*a* are formed in the fixed electrodes 24 and 26, respectively, and insulating support members 28 are formed between the diaphragm 22 and the fixed electrodes 24 and 26.

In addition, the diaphragm used for the electrostatic speaker should have high surface resistance such that positive charges that are charged with a high voltage can be stably maintained in the diaphragm, and should appropriately prevent the discharge between the diaphragm and the electrodes caused by a high voltage applied to the diaphragm. In addition, the diaphragm should have a strong initial tensile strength in order to prevent the diaphragm from being attracted to the electrode when no signal is input and the positive charge on the diaphragm from being discharged.

In order to satisfy these characteristics, the diaphragm for an electrostatic speaker according to the related art is formed as follows: a petrochemical polymer film, such as a thin polyester film having a relatively strong tensile strength, is stretched to be adhered to a frame; a heterogeneous material, such as nylon or PVC, is coated on one surface of the polyester film in order to reduce low-frequency resonation within an audible frequency range; and high-resistance conduction coating and antistatic coating using a diluted solution of graphite powder is performed on the other surface of the polyester film.

However, the diaphragm obtained in this way is non-ventilative, and has the following problems. That is, when the intensity of a signal input to the fixed electrode increases and the diaphragm is close to the fixed electrode, a ground effect is generated.

The ground effect means that, when an object rapidly approaches the ground, high air resistance occurs between the ground and the object within a specific range of distance from the ground, which prevents the object from approaching the ground.

For example, flying objects, such as a helicopter and a GEV (ground effect vehicle), use the characteristics of the ground effect. When a helicopter hovers near the ground, the generated air hits the ground, causing the air between the helicopter and the ground to be compressed. The compressed air serves as a cushion that helps the helicopter to hover.

This effect is called the ground effect, which saves the power of the helicopter. The height incurred by the ground effect corresponds to the diameter of a main rotor while the helicopter is hovering.

FIG. 4 is a graph illustrating the relationship between the ratio of the height of the rotor to the diameter of the rotor (horizontal axis) and the ratio of an increment in the thrust of the rotor (vertical axis). As shown in FIG. 4, as the height of the rotor decreases, the helicopter is more affected by the ground effect, and the increment in the thrust of the rotor is about 20% when the ratio of the height of the rotor to the diameter of the rotor is 0.25. In addition, the increment in the thrust of the rotor drastically decreases to about 7% when the ratio of the height of the rotor to the diameter of the rotor is 0.5. Further, the increment in the thrust of the rotor is 0 when the ratio of the height of the rotor to the diameter of the rotor is 1.25, and the helicopter is not affected by the ground effect.

The principle of the ground effect can be applied to the electrostatic speaker, which will be described below. That is, when a distance d1 between the holes formed in the fixed electrode corresponds to the diameter of the rotor of the helicopter and a distance d2 between the fixed electrode and the diaphragm corresponds to the height of the rotor of the helicopter, a variation in the thrust of the helicopter according to the relationship between the diameter of the rotor and the height of the rotor corresponds to a pressure variation between the diaphragm and the fixed electrode according to the relationship between the distances d1 and d2.

Therefore, as the diaphragm becomes close to the fixed electrode, it is more difficult for the air between the diaphragm and the fixed electrode to pass through the holes formed in the fixed electrode. As a result, the diaphragm has high air resistance, and sound pressure is lowered.

The reduction in the sound pressure becomes larger as the intensity of an input signal increases and the diaphragm becomes closer to the fixed electrode. In addition, as an input frequency is lowered, the amplitude of the diaphragm increases when a signal having the same intensity is input. In this case, the diaphragm is less affected by the ground effect. Therefore, the intensity of the output sound becomes lower as the frequency decreases, which makes it difficult to obtain a uniform frequency reproduction characteristic.

In order to overcome the ground effect, a method of increasing the ratio of the holes to the fixed electrode (the number of holes per unit area) or a method of increasing the distance between the diaphragm and the fixed electrode may be considered. In the former case, an area in which electrostatic attractive force is generated is reduced, and the electrostatic attractive force is weakened, which results in a reduction in reproduction sound pressure. In the latter case, when the distance between the diaphragm and the fixed electrode increases, the electrostatic attractive force is weakened, and thus reproduction sound pressure is lowered.

Further, a process of manufacturing the diaphragm for an electrostatic speaker according to the related art is complicated. In addition, in the process of adhering the diaphragm in a tensile state to the frame at a temperature of about 100° C. or more according to the related art, it is difficult to maintain the tensile state of the diaphragm since a polyester film, which is the main ingredient of the diaphragm, has low thermal resistance, and it requires a lot of time to adhere the diaphragm to the frame due to a very stable chemical structure.

In the high resistance conduction coating method using a polymer film, such as a polyester film, it is difficult to perform uniform coating, resulting in charge being concentrated on a portion of the diaphragm. As a result, discharge occurs easily, and arc accompanied with the discharge melt the polymer film, which results in a short life span of the diaphragm. In order to solve these problems, a method of arranging the diaphragm and the fixed electrode at a sufficient distance therebetween not to generate discharge has been proposed. However, this method is not a solution to these problems since the sensitivity of the speaker is lowered.

In addition, the speaker needs to have a characteristic of radially and uniformly spreading sound. However, since the movement of the diaphragm of the electrostatic speaker is done as the planar vibration, it is difficult to naturally spread sound due to the directivity of a high-pitched sound.

In order to solve these problems, in the electrostatic speaker according to the related art, a panel is formed in a semi-cylindrical shape having a length corresponding to the height of a human being, or when the length of the panel is smaller than the height of the human being, the panel is inclined backward so as to be the same height of the listener's ear where the sound is spread. However, since the diaphragm is formed in a semi-cylindrical shape, it is difficult to perfectly realize a radial and uniform sound spread. In addition, a method of additionally providing an electrical delay circuit to operate the diaphragm like a spherical surface has been proposed. However, this method has problems in that the size of a speaker increases, the structure of the speaker becomes complicated, and the amount of data to be processed increases.

DISCLOSURE OF INVENTION

Technical Problem

An object of the invention is to provide an electrostatic speaker capable of reducing air resistance and the ground effect occurring between a diaphragm and a fixed electrode, while satisfying all characteristics required for the electrostatic speaker, thereby obtaining a uniform frequency reproduction characteristic over the entire frequency range.

Another object of the invention is to provide an electrostatic speaker including a diaphragm that can be easily manufactured by using a thermoplastic adhesive.

Still another object of the invention is to provide an electrostatic speaker having a diaphragm that can be simply manufactured at low manufacturing costs.

Yet another aspect of the invention is to provide an electrostatic speaker having a diaphragm that can radially and uniformly spread sound without complicating the structure of a speaker and increasing the amount of data to be processed.

Technical Solution

In order to achieve the above-mentioned objects, according to an embodiment of the invention, an electrostatic speaker includes a diaphragm and a sound generator that includes one fixed electrode or a pair of fixed electrodes that are arranged at a predetermined gap from the diaphragm. A plurality of ventilation holes are formed in the diaphragm.

The diaphragm may be made from Korean paper.

A plurality of holes may be formed in the fixed electrode, and portions of the diaphragm corresponding to the plurality of holes may be non-ventilative.

A concave-convex portion may be formed on the surface of the fixed electrode facing the diaphragm.

When the diaphragm is made from Korean paper, the diaphragm may be formed in a hemispherical shape, and the fixed electrode may also be formed in a hemispherical shape at a predetermined gap from the diaphragm.

A plurality of holes may be formed in the fixed electrode, and the distance between the holes and the distance between the diaphragm and the holes may be set in a high frequency band such that the ground effect does not occur between the fixed electrode and the diaphragm.

Advantageous Effects

According to the invention, it is possible to provide an electrostatic speaker capable of reducing the ground effect occurring between a diaphragm and a fixed electrode to increase an output sound pressure, while satisfying all characteristics required for the electrostatic speaker, thereby obtaining a uniform frequency reproduction characteristic over the entire frequency range.

Further, according to the invention, in the diaphragm, portions except for a portion in which the ground effect mainly occurs are made non-air-permeable, which makes it possible to increase an output sound pressure and further improve a frequency reproduction characteristic.

Furthermore, according to the invention, a concave-convex portion is formed on the surface of the fixed electrode, which makes it possible to reduce the ground effect and decrease the size and thickness of an electrostatic speaker.

Moreover, according to the invention, the diaphragm is made from Korean paper having high thermal resistance, and thus the diaphragm can be easily adhered to a frame in a high temperature environment. In addition, the diaphragm made from the Korean paper satisfies all physical properties required for an electrostatic speaker, which makes it possible to simplify a process of manufacturing a diaphragm for an electrostatic speaker and reduce the overall manufacturing cost.

Further, according to the invention, the diaphragm made from the Korean paper is formed in a hemispherical shape, which makes it possible to perfectly realize a uniform and radial sound spread.

BRIEF DESCRIPTION OF THE DRAWINGS

FIGS. 1 and 2 are diagrams schematically illustrating the structure of a single ended speaker.

FIG. 3 is a diagram schematically illustrating the structure of a double ended speaker.

FIG. 4 is a graph illustrating the ground effect.

FIG. 5 is an enlarged view illustrating the surface of Korean paper according to an embodiment of the invention.

FIG. 6 is a diagram illustrating a chemical formula of the Korean paper according to the embodiment of the invention.

FIG. 7 is graphs illustrating frequency characteristics of an electrostatic speaker according to an embodiment of the invention.

FIG. 8 is a diagram schematically illustrating an electrostatic speaker according to another embodiment of the invention.

FIG. 9 is a diagram schematically illustrating an electrostatic speaker according to still another embodiment of the invention.

FIG. 10 is a diagram schematically illustrating an electrostatic speaker according to yet another embodiment of the invention.

MODE FOR THE INVENTION

The following embodiment of the invention is applied to an electrostatic speaker shown in FIGS. 1 to 3, and it will be understood that the invention can be applied to an electrostatic speaker having multiple electrostatic speakers shown in FIGS. 1 to 3.

First Embodiment

A first embodiment of the invention is characterized by a ventilative diaphragm for an electrostatic speaker. In the case of a non-ventilative diaphragm according to the related art, when a diaphragm is as close to a fixed electrode as it is affected by a ground effect, an increase in the pressure between the diaphragm and the fixed electrode due to the ground effect is directly transmitted to the non-ventilative diaphragm, which causes a reduction in sound pressure in a low frequency band due to the ground effect. However, according to this embodiment, when the pressure between the ventilative diaphragm and the fixed electrode increases due to the ground effect, the effect of the increased pressure on the ventilative diaphragm is reduced by fine holes formed in the ventilative diaphragm. Therefore, the ventilative diaphragm is less affected by the sound pressure that is lowered due to the ground effect in a low frequency band than the non-ventilative diaphragm according to the related art.

Example 1

A ventilative diaphragm according to Example 1 is obtained as follows. A polyester film is stretched to be adhered to a fixed frame, and a heterogeneous material, such as nylon or PVC (polyvinyl chloride), is coated on one surface of the polyester film in order to reduce low-frequency resonation within an audible frequency range. Then, high-resistance conduction coating and antistatic coating using a diluted solution of graphite powder is performed on the other surface of the polyester film.

Subsequently, a plurality of fine holes are formed in the diaphragm by punching, thereby manufacturing a ventilative diaphragm according to Example 1.

According to Example 1, the fine holes are formed in a general non-ventilative diaphragm to form a diaphragm having ventilation characteristic, which makes it possible to reduce the effect of the increased pressure between the diaphragm and the fixed electrode due to the ground effect.

Example 2

Example 2 is characterized in that a diaphragm is made from Korean paper. The inventors have studied a new diaphragm material for solving various problems of the diaphragm for an electrostatic speaker according to the related art. Then, the inventors' study found that Korean paper, which is a Korean traditional paper, had a high degree of ventilation and formability, while satisfying all physical characteristics required for a diaphragm for an electrostatic speaker (a high tensile strength, high resistance, and a characteristic of maintaining a tensile state at a temperature that enables thermal adhesion).

The Korean paper is a bast fiber obtained from, sources, such as *Broussonetia kazinoki* (paper mulberry), *Morus* (mulberry tree), *Edgeworthia papyrifera*, and *Wikstroemia trichotoma*.

A method of manufacturing the Korean paper includes: a process of placing a bundle of material, such as paper mulberries upright into a container, boiling it until the bark can be easily stripped from the paper mulberries, stripping the bark from the paper mulberries, and drying the bark of the paper mulberries; a process of soaking the bark in water, extracting only bast fibers from the bark, boiling the bast fibers in lye for about three hours or more, and squeezing water from the bast fibers using a compressor; and a process of soaking the bast fibers of the paper mulberries in clean water, mixing liquid squeezed from sunset-hibiscus with the water such that the bast fibers can be uniformly dispersed in the water, and straining a paper solution using a mesh.

FIG. 5 is an enlarged view of the surface of the Korean paper, and FIG. 6 is a diagram illustrating a chemical formula of the Korean paper.

As shown in FIGS. 5 and 6, the Korean paper consists of cellulose, which is a straight-chained polymer obtained by polymerizing several thousands of glucoses, and cellulose molecules form a fibril, and the fibril is coupled to a compound, such as hemicellulose (polymer having various kinds of saccharides, which are similar to glucose, coupled thereto) or lignin, to form a fibrous tissue.

The Korean paper is manufactured by the hydrogen bond between the cellulose molecules in addition to the physical mixture of these fibers. The hydrogen bond occurs since an oxygen atom attracts a hydrogen nucleus in a plurality of hydroxyl groups within a molecule, while having extra electrons. The strength of the hydrogen bond is weaker than that of a covalent bond, but since the hydrogen bond occurs between a great number of long polymers, the overall strength of the hydrogen bond is strong.

Since the length of fibers of the Korean paper is large and the width of the fibers is small, the bonding strength between the fibers is strong. In addition, since fibril forming the fabric of the cellulose is arranged in the axial direction, the strength of the fiber is strong. For example, the length of the bast fiber of the paper mulberry is in the range of 3.33 to 17.08 mm (average length is 8.72 mm), the width thereof is in the range of 15.1 to 43.6μm (average width is 23.3μm), the lumen width thereof is in the range of 3.4 to 29.7μm (average lumen width is 11.7μm), and the extension rate thereof is in the range of 4 to 8%.

The Korean paper has a high extension rate and a strong strength, similar to leather due to the long length and the structure of the bast fiber of the paper mulberry, which is a main ingredient of the Korean paper, and variation in the characteristics of the bast fiber during a manufacturing process. Therefore, the diaphragm made from the Korean paper can be maintained in a high-tension state, and can be prevented from being attached to the electrode when no signal is supplied. As a result, it is possible to prevent positive charges of the diaphragm to being discharged.

Further, since the diaphragm made from the Korean paper has higher heat resistance than a petrochemical polymer film according to the related art, the diaphragm is little damaged by a high-voltage arc discharge. Therefore, it is possible to apply a higher charging voltage to the diaphragm as compared to the related art, and thus improve the sensitivity of an electrostatic speaker. In addition, it is possible to increase the ratio of a high output sound pressure to an input signal.

Furthermore, in order to reduce low-frequency resonance, in a petrochemical polymer film, such as the existing polyester film, a heterogeneous material, such as liquefied nylon or PVC liquid, is coated on a film and is then dried, thereby forming a non-extended film. On the other hand, no additional process is performed on the diaphragm made from the Korean paper, which is in an extended state, and thus little low-frequency resonance occurs in the diaphragm in an audible frequency range (20 Hz to 20 KHz). As a result, an electrostatic speaker having the diaphragm made from the Korean paper outputs a high-quality sound and has an excellent frequency characteristic.

Moreover, a process of manufacturing the diaphragm with the Korean paper is easier than a process of manufacturing a petrochemical polymer film according to the related art. The above-mentioned three processes are needed to manufacture the diaphragm made of the polyester film that has been widely used, but only one process of adhering the Korean paper in a tensile state to the frame is needed to manufacture the diaphragm according to Example 2.

In the process of adhering the diaphragm in a tensile state to the frame at a temperature of about 100° C. or more according to the related art, it is difficult to maintain the tensile state of the diaphragm since the polyester has low thermal resistance, and it requires a lot of time to adhere the diaphragm to the frame since a chemical structure is very stable. On the other hand, according to this embodiment, it is possible to easily and rapidly perform the process of adhering the diaphragm to the frame due to the characteristic fabric binding structure of the Korean paper and the high thermal resistance of the Korean paper in a high tensile state.

As described above, the Korean paper has better characteristics than the existing diaphragm while satisfying physical characteristics required for the electrostatic speaker, and the Korean paper makes it possible to simplify a manufacturing process.

The inventors found that the ventilation of the diaphragm made from the Korean paper made it possible to more effectively prevent the ground effect occurring between the diaphragm and the fixed electrode, as compared to the non-ventilative diaphragm according to the related art. The inventors' experiment proved that the ventilative diaphragm effectively reduced the ground effect better in a low frequency band in which the amplitude of vibration of the diaphragm is large.

As described above, Example 2 is characterized in that the ventilative Korean paper is used for the diaphragm of the electrostatic speaker to improve the characteristics of the non-ventilative diaphragm according to the related art.

In the non-ventilative diaphragm according to the related art, when the diaphragm is as close to as it is affected by the ground effect, the pressure increased between the diaphragm and the fixed electrode due to the ground effect is directly transmitted to the non-ventilative diaphragm, which causes a reduction in sound pressure within a low frequency band due to the ground effect. However, according to Example 2, fine holes formed in the diaphragm made from the Korean paper prevent an increase in the pressure between the diaphragm and the fixed electrode due to the ground effect. As a result, the ventilative diaphragm is less affected by the reduction in sound pressure within a low frequency band due to the ground effect than the non-ventilative diaphragm according to the related art.

FIG. 7 illustrating the experimental result of operational characteristics of an electrostatic speaker having the diaphragm made from the Korean paper, that is, the relationship between a sound pressure and a frequency, according to Example 2, and the experimental result of operational characteristics of an electrostatic speaker having the non-ventilative diaphragm according to the related art. As can be seen from the graphs shown in FIG. 7, the sound pressure is remarkably improved in a low frequency band according to Example 2. That is, as can be seen from the comparison between the ventilative diaphragm according to Example 2 shown at "(a)" in FIG. 7 and the non-ventilative diaphragm based on the related art shown at "(b)" in FIG. 7, when an input signal having the same intensity Is is input, the sound pressure is improved by about 3 dB according to Example 2, which corresponds to a 40% increase in the input energy.

The reason why the speaker shown in "(a)" at FIG. 7 according to Example 2 and the speaker shown at "(b)" in FIG. 7 according to the related art show a similar sound pressure in a high frequency band is that a sufficient gap to prevent the ground effect is set between the diaphragm and the fixed electrode in a low frequency band.

For example, when half the amplitude of the diaphragm at a reference frequency between a low frequency band and a high frequency band is d3 in response to rated input energy input to the electrostatic speaker having the structure shown in FIG. 3, and when d3, a distance d1 between holes formed in the fixed electrode, and a distance d2 between the fixed electrode and the diaphragm satisfy $(1.25)\times d1 \leqq (d2-d3)$, the diaphragm is not affected by the ground effect in the high frequency band according to the principle of the ground effect (FIG. 4).

Second Embodiment

As shown in FIG. 8, a second embodiment is characterized in that a portion of the diaphragm that is made from the Korean paper has a ventilation characteristic in order to overcome the ground effect.

Since the ground effect mainly occurs between a diaphragm 72 and a flat portion of a fixed electrode 74 in which holes 74*a* are not formed, a ventilation characteristic is not imparted to a portion 72*a* of the diaphragm 72 corresponding to the holes 74*a* of the fixed electrode 74. In this way, when the air permeable property is imparted to only a portion of the diaphragm required to overcome the ground effect, it is possible to further increase an output sound pressure.

In order to impart the ventilation characteristic to only a necessary portion, a deposit, such resin or starch, or paint, such as varnish, may be coated on the portion 72*a* of the diaphragm corresponding to the holes 74*a* of the fixed electrode 74. In addition, in the case of a double ended electrostatic speaker, it is preferable that holes of both electrodes face each other in order to balance the sound pressure.

Third Embodiment

As shown at "(a)" in FIG. 9, a third embodiment is characterized in that a concave-convex portion 84*b* is formed on the surface of a fixed electrode 84 that faces a diaphragm 82.

In terms of air that is considered as a viscous material, a so-called boundary layer theory may be applied between the diaphragm 82 and the fixed electrode 84. That is, as shown at "(b)" in FIG. 9, in the electrostatic speaker according to the related art, the air in the vicinity of a fixed electrode 84' is confined in a boundary layer and is compressed. Therefore, the compressed air cannot easily pass through holes 84*a'* that are formed in the fixed electrode 84'.

That is, in the electrostatic speaker according to the related art, the ground effect becomes more remarkable due to the boundary layer of the air.

However, in this embodiment of the invention, the concave-convex portion 84*b* formed on the fixed electrode 84 disturbs the boundary layer to generate a warm current that enables a smooth air flow. Therefore, the width of the boundary layer is reduced, which prevents the ground effect from being noticeable.

In particular, when the ventilative diaphragm according to this embodiment is applied, the ground effect is further reduced due to the ventilation characteristic of the diaphragm, which makes it possible to further improve the sound pressure. In addition, according to this embodiment, it is possible to improve the sensitivity by reducing the distance between the diaphragm and the fixed electrode that are affected by the ground effect, and thus reduce the thickness and size of a speaker.

Fourth Embodiment

A fourth embodiment is characterized in that a diaphragm made from the Korean paper is formed in a hemispherical shape. When the Korean paper having high formability is formed in a hemispherical shape, sound can be radially and uniformly spread.

Therefore, when the diaphragm made from the Korean paper is used for the electrostatic speaker, it is not necessary to add a complicated electrical circuit required to reproduce an artificial spherical wave. In addition, the diaphragm made from the Korean paper makes it possible to reproduce a natural sound due to the characteristics of the Korean paper.

This embodiment is characterized in that the diaphragm made from the Korean paper is formed in a spherical shape such that the sound can be radially spread. As described above, since the Korean paper has high formability, it can be formed in a spherical shape.

FIG. 10 shows a sound generator 90 of an electrostatic speaker having the hemispherical diaphragm made from the Korean paper according to this embodiment. As shown in FIG. 10, a diaphragm 92 is formed in a hemispherical shape, and two electrodes 94 and 96 are also formed in hemispherical shapes corresponding to the shape of the diaphragm at a regular interval from the diaphragm 92. Therefore, the electrostatic speaker according to this embodiment does not need to have a specific device for radially spreading the sound, unlike the related art, and can improve imperfect radiational characteristics of the semi-cylindrical diaphragm according to the related art.

Although the present invention has been described in connection with the exemplary embodiments of the invention, it will be apparent to those skilled in the art that various modifications and changes may be made without departing from the scope and spirit of the invention. Therefore, it should be understood that the above-described embodiments are not limitative, but illustrative in all aspects. In addition, it will be understood that combinations of the above-described embodiments are also included in the scope of the invention.

What is claimed is:

1. An electrostatic speaker comprising:

a diaphragm; and a sound generator that includes one fixed electrode or a pair of fixed electrodes that are arranged with a predetermined gap from the diaphragm, a distance d1 between two neighboring hole of a plurality of holes formed in the fixed electrode, and a distance d2 between the fixed electrode and the diaphragm, and a half the amplitude of the diaphragm at a reference frequency in an audible frequency range is d3 in response to rated input energy input to the electrostatic speaker satisfy $(1.25)\times d1>(d2-d3)$, wherein a plurality of ventilation holes are formed in the diaphragm wherein the plurality of holes are formed in the fixed electrode.

2. The electrostatic speaker of claim 1, wherein the diaphragm is made from Korean paper.

3. The electrostatic speaker of claim 1, wherein a plurality of holes are formed in the fixed electrode, and portions of the diaphragm facing the plurality of holes are non-ventilative.

4. The electrostatic speaker of claim 2, wherein a plurality of holes are formed in the fixed electrode, and portions of the diaphragm facing the plurality of holes are non-ventilative.

5. The electrostatic speaker of claim 1, wherein a concave-convex portion is formed on the surfacE of the fixed electrode facing the diaphragm.

6. The electrostatic speaker of claim 2, wherein a concave-convex portion is formed on the surface of the fixed electrode facing the diaphragm.

7. The electrostatic speaker of claim 2, wherein the diaphragm is formed in a hemispherical shape, and the fixed electrode is formed in a hemispherical shape at a predetermined gap from the diaphragm.

* * * * *